United States Patent [19]

Heath

[11] Patent Number: 4,596,096

[45] Date of Patent: Jun. 24, 1986

[54] SCAFFOLD ASSEMBLY FOR SIMULATING THE APPEARANCE OF A CHRISTMAS TREE

[76] Inventor: Millard D. Heath, 3030 Country Club Rd., Denton, Tex. 76201

[21] Appl. No.: 705,237

[22] Filed: Feb. 25, 1985

[51] Int. Cl.[4] ..... A47G 33/06; E04G 1/20

[52] U.S. Cl. ..... 52/6; 52/38; 52/638; 182/132; 182/179; 428/20

[58] Field of Search ..... 108/92; 182/178, 179, 182/132; 52/6, 8, 9, 10, 38, 638; 428/13, 18, 19, 20

[56] References Cited

U.S. PATENT DOCUMENTS

| | | | |
|---|---|---|---|
| D. 23,079 | 2/1894 | Hermann | 108/92 X |
| 949,196 | 2/1910 | McIntosh | 108/92 |
| 2,665,174 | 1/1954 | Clarke | 182/178 X |
| 2,682,727 | 7/1954 | Keljik | 428/13 X |
| 2,933,194 | 4/1960 | Rose | 108/92 |
| 3,674,612 | 7/1972 | Gehl, Jr. | 428/19 X |
| 3,698,511 | 10/1972 | Dohan | 182/178 X |

*Primary Examiner*—Henry F. Epstein
*Attorney, Agent, or Firm*—Glaser, Griggs & Schwartz

[57] ABSTRACT

A scaffold assembly for supporting members of a musical choir in a standing arrangement simulating the appearance of a traditional Christmas tree is disclosed. The scaffold assembly is arranged in tiers of horizontal standing boards rising one above and one behind another in stairway fashion from a base tier of standing boards to an uppermost tier of standing boards. The horizontal standing boards of each tier are arranged to form a segmented arc in a plane which is transverse to the vertical axis of the scaffold assembly. The tiers are stabilized by a plurality of horizontal support beams and upright support posts and a central stanchion. A first set of horizontal support beams project radially outwardly from a central plate, which is attached to the central stanchion, to the underside of the standing boards, and are attached to the respective support posts at the perimeter of selected ones of the tier. Each tier includes a second set of horizontal support beams, which are connected to respective support posts at one end, and extend beneath the standing boards to provide support therefor. Stair steps are provided along each side of the assembly and chest rails are provided in a segmented arc pattern corresponding with the segmented arc defined by the respective standing boards of each tier.

10 Claims, 6 Drawing Figures

SCAFFOLD ASSEMBLY FOR SIMULATING THE APPEARANCE OF A CHRISTMAS TREE

BACKGROUND OF THE INVENTION

1. Field of the Invention

This invention relates generally to the art of scaffold structures, and in particular to a scaffold for holding members of a concert choir in an upright standing arrangement which simulates the appearance of a Christmas tree.

2. Description of the Prior Art

Various organizations, including church groups, celebrate the Christmas season each year by the presentation of special musical programs. These programs usually include special presentations of Christmas music sung by members of a choir, which often include special stage lighting, decorations, costumes and other arrangements. Typically, choir members arrange themselves on stage in a series of "stair-step" levels or tiers, with the largest number of choir members on the base tier and each successively higher tier containing fewer members.

To effect such an arrangement, portable platforms or boxes of different heights are used as support stands for the choir members. While such portable platforms provide flexibility in on-stage arrangements, they are often unstable for choir members to stand on, particularly at the higher levels. In addition, such portable platforms are not suitable for attaching music holders, decorations and the like, which enhance the choir's performance.

Alternatively, temporary bleachers or grandstands, such as those used at sporting events, may be erected for a more stable platform. Such bleachers typically include a plurality of parallel support boards arranged in stair-step tiers. Such an arrangement is not suitable for church sanctuaries, auditoriums and the like which are substantially in the shape of a semi-circle, because observers seated at the far sides of the building will not have a frontal view of the choir. In addition, such bleachers typically do not have guard rails for the safety and convenience of the choir members and are not suitable for receiving attachments, such as music holders, decorations and the like.

OBJECTS OF THE INVENTION

It is therefore the primary object of the present invention to provide a scaffold assembly for simulating the appearance and shape of a traditional Christmas tree.

It is another object of the invention to provide an improved scaffold assembly arranged in tiers for supporting the members of a choir or other group of performers.

It is yet another object of the invention to provide a more stable scaffold assembly arranged in tiers for supporting the members of a choir or other group of performers.

It is still another object of the invention to provide an improved scaffold assembly arranged in tiers for supporting the members of a choir or other group of performers, which is suitable for receiving decorations, artificial or live greenery and other accessories to enhance the choir's performance.

It is a further object of the invention to provide an improved scaffold assembly arranged in tiers for supporting the members of a choir or other group of performers, which can be quickly and conveniently erected at the site of the performance.

SUMMARY OF THE INVENTION

These and other objects are accomplished in accordance with the present invention wherein a scaffold assembly is provided for supporting members of a musical choir or the like in a standing arrangement simulating the appearance of a Christmas tree. The scaffold assembly is comprised of a plurality of tiers of horizontal standing boards rising one above and one behind another from a base tier of standing boards to an uppermost tier of standing boards. Each tier includes a plurality of horizontal standing boards disposed end-to-end and arranged to form a segmented arc substantially in a plane which is transverse to the vertical axis of the scaffold assembly and a plurality of horizontal support beams, at least portions of which extend beneath the standing boards at the respective intersections of the standing boards. The scaffold assembly further includes a plurality of upright support posts, projecting upwardly from the horizontal support beams of the base tier. Each support post is attached to corresponding pairs of horizontal support beams at the respective forward edges of the standing boards of a corresponding tier and the respective rear edges of the standing boards of the next lower tier. The horizontal support beams are attached to respective pairs of the support posts at the respective forward and rear edges of the standing boards of the respective tiers. A central stanchion post projects upwardly from one of the support beams of the base tier. Selected ones of the horizontal support beams extend radially outwardly from predetermined positions along the stanchion post to the respective intersections of the standing boards.

In one embodiment, the scaffold assembly includes a plurality of tie plates attached to the central stanchion post at predetermined positions therealong corresponding to selected ones of the tiers. The horizontal support beams associated with such tiers are attached to the respective tie plates at one end and extend substantially radially outwardly therefrom to the respective intersections of the standing boards of the respective tiers. The horizontal support beams extend radially outwardly from the tie plates with substantially equal angular intervals therebetween.

In a preferred embodiment an end portion of each upright support post projects above the forward edges of the standing boards of the corresponding tier and a plurality of chest rails are connected to the end portions of selected ones of the upright support posts in each tier. The chest rails define a segmented arc in a plane substantially parallel to the plane in which the standing boards define a segmented arc in each tier. Disposed beneath the standing boards of each tier are first and second parallel support members, which extend along the respective major axes of the standing boards and are attached thereto.

To facilitate ascent and descent of the scaffold assembly, first and second handrails are provided on opposite sides of the assembly. The handrails extend substantially from the base tier to the uppermost tier of the scaffold assembly. The end portions of those upright support posts which are not connected to the chest rails are connected to the corresponding handrail. Located adjacent to the handrails on each side of the scaffold assembly are a plurality of steps, which are positioned between each of the tiers.

The central stanchion post, upright support posts, chest rails and hand rails are each comprised of an elongated metal beam having a substantially U-shaped channel extending along the major axis thereof. The horizontal support beams are each comprised of an elongated metal beam having a substantially L-shaped section. To further enhance the stability of the scaffold assembly, a plurality of brace members are attached to the assembly, adjacent to the intersections of selected ones the horizontal support beams and upright support posts. The brace members extend diagonally between adjacent support posts in an X-shaped pattern.

The scaffold assembly of the present invention provides a stable, attractive structure, which simulates the appearance of a traditional Christmas tree. The structure can be quickly and conveniently assembled on site and is well-suited for hanging accessories such as music holders, Christmas decorations, artificial or live greenery and the like.

BRIEF DESCRIPTION OF THE DRAWINGS

Still further objects and advantages of the invention will be apparent from the detailed description and claims when read in conjunction with the accompanying drawings wherein:

DETAILED DESCRIPTION OF THE PREFERRED EMBODIMENT

Figure 1:
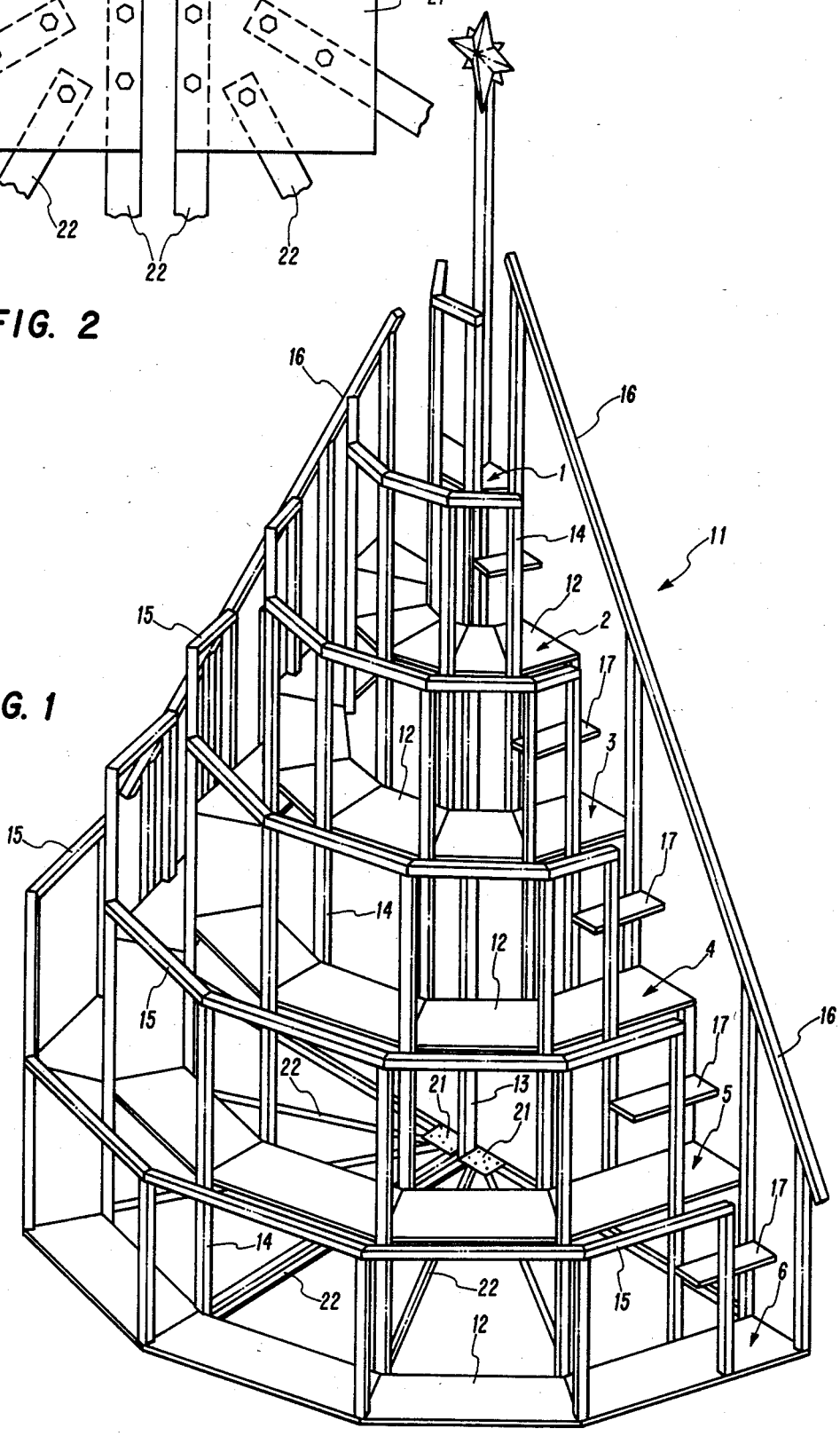
FIG. 1 is a perspective view of a preferred embodiment of the scaffold assembly according to the present invention.

Referring now to FIG. 1, a scaffold assembly 11 according to the present invention is illustrated. Scaffold assembly 11 is constructed so as to simulate the appearance of a traditional Christmas tree and is arranged in tiers of horizontal standing boards 12 rising one above and one behind the other in stairway fashion from a base tier 6 to an uppermost tier 1. Standing boards 12 are arranged to form a segmented arc in a plane which is transverse to the vertical axis of scaffold assembly 11, the length of the arc becoming successively greater moving from uppermost tier 1 to base tier 6. At the center rear portion of scaffold assembly 11, a central stanchion post 13 rises from the base to the apex of scaffold assembly 11 to provide a central stabilizing member along the vertical axis. An ornament, such as a star as shown in FIG. 1, may be affixed to stanchion post 13.

A plurality of upright support posts 14 project upwardly from the base of assembly 11, the end portion of support posts 14 extending above the respective forward edges of standing boards 12 of the corresponding tiers. A plurality of chest rails 15 are attached to the end portions of selected ones of support posts 14 in each tier 1–6 by means of connector plates (not shown) affixed to support posts 14, to which chest rails 15 are bolted using $\frac{3}{8}$ inch × 1 inch bolts and hex nuts. The ends of chest rails are bevelled so that they are in abutting relationship with one another. Chest rails 15 define a segmented arc in a plane which is substantially parallel to the plane in which the corresponding standing boards 12 are arranged in a segmented arc in each tier. The end portions of each support post 14 extend sufficiently above the corresponding standing boards 12 so that the chest rails 15 attached thereto are at approximately chest level for a person who is standing on the corresponding standing boards 12. Chest rails 15 are preferably comprised of steel unistrut material having a substantially U-shaped cross-section and a vertical channel extending along the length thereof. The dimensions of chest rails 15 are preferably $1\frac{5}{8}$ inch × $1\frac{5}{8}$ inch × 12 guage (0.109 inch thickness). Chest rails 15 are attached to the respective support posts 14 so that the vertical channels of chest rails 15 face upwardly.

To facilitate ascent and descent of scaffold assembly 11, a hand rail 16 is disposed on each side of assembly 11. Hand rails 16 extend substantially from base tier 6 to uppermost tier 1 and are connected to the respective end portions of support posts 14 which are not connected to chest rails 15. The ends of support posts 14 which are connected to hand rails 16 are bevelled in an upward direction so that hand rails 16 rise diagonally upward from base tier 6 to uppermost tier 1. Hand rails 16 are attached to support posts 14 using $\frac{3}{8}$ inch × 1 inch bolts and strut nuts, with the vertical channel of each hand rail 16 facing inwardly toward scaffold assembly 11. Located adjacent to hand rails 16 on each side of scaffold assembly 11 are a plurality of steps 17, which are positioned approximately midway between successive tiers.

Figure 2:
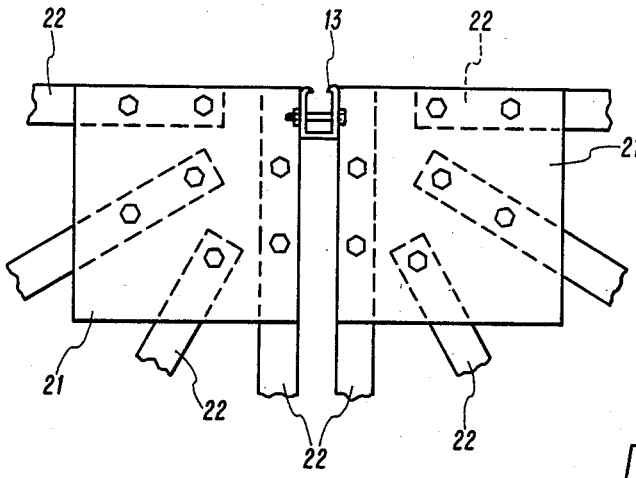
FIG. 2 is a top plan view of a tie plate attached to the central stanchion post of the scaffold assembly according to the present invention, illustrating in phantom the horizontal support beams extending radially outwardly from beneath the tie plate.

Attached to central stanchion post 13 at selected tiers are a plurality of tie plates 21, one of which is shown in FIG. 2. Bolted to the underside of each tie plate 21 are a plurality of horizontal support beams 22, which extend radially outward from tie plate 21 to the respective intersections of standing boards 12 of the corresponding tier, as will be described in greater detail hereafter. Horizontal support beams 22 are oriented so that there are substantially equal angular intervals between adjacent ones of them in the same tier. Stanchion post 13 is preferably comprised of a steel unistrut material, having a vertical channel extending along the length thereof, with dimension $1\frac{5}{8}$ inch × 2-7/16 inch × 12 guage (0.109 inch thickness).

Figure 3:
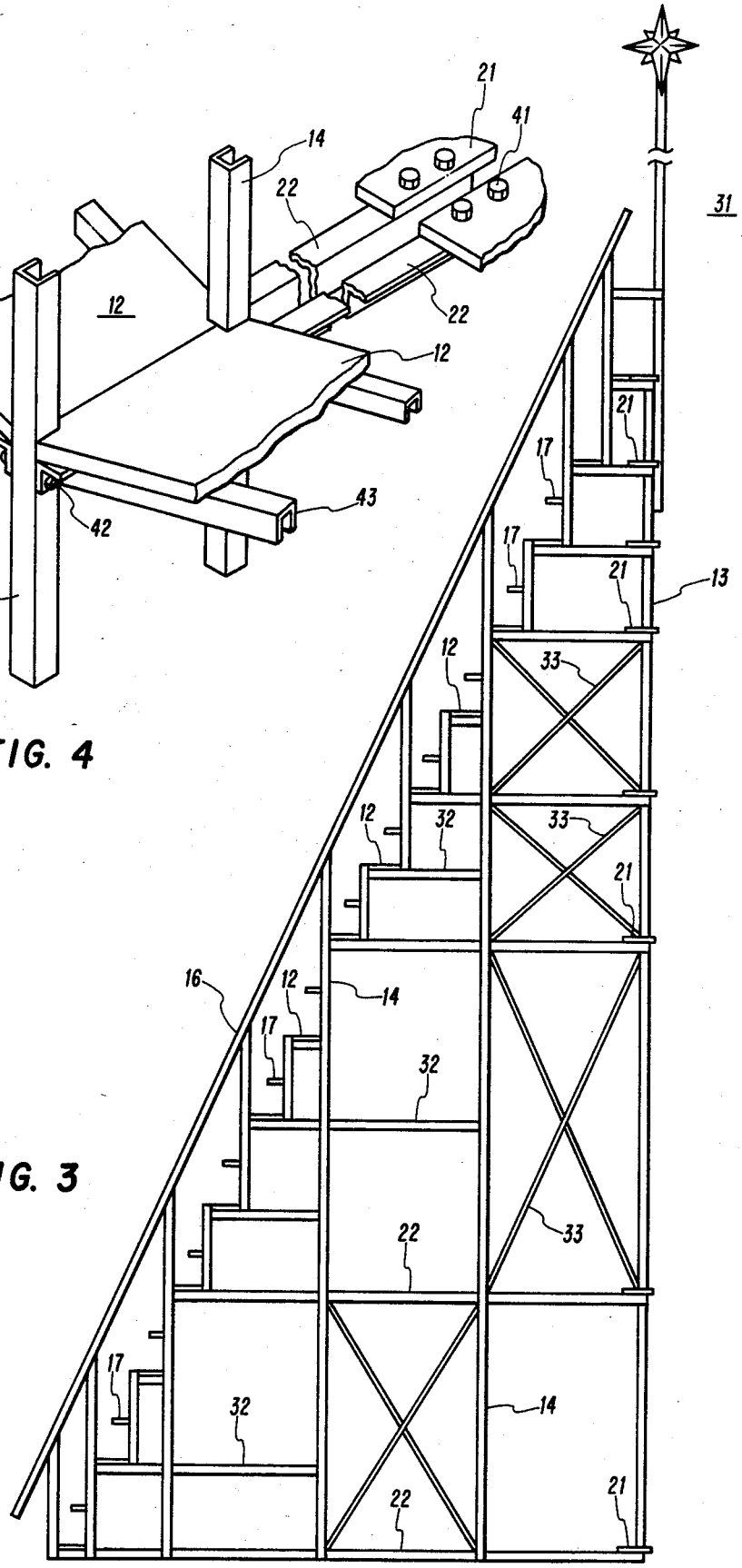
FIG. 3 is a section view illustrating the respective interconnections among the various support members of the scaffold assembly according to the present invention.
Figure 5:
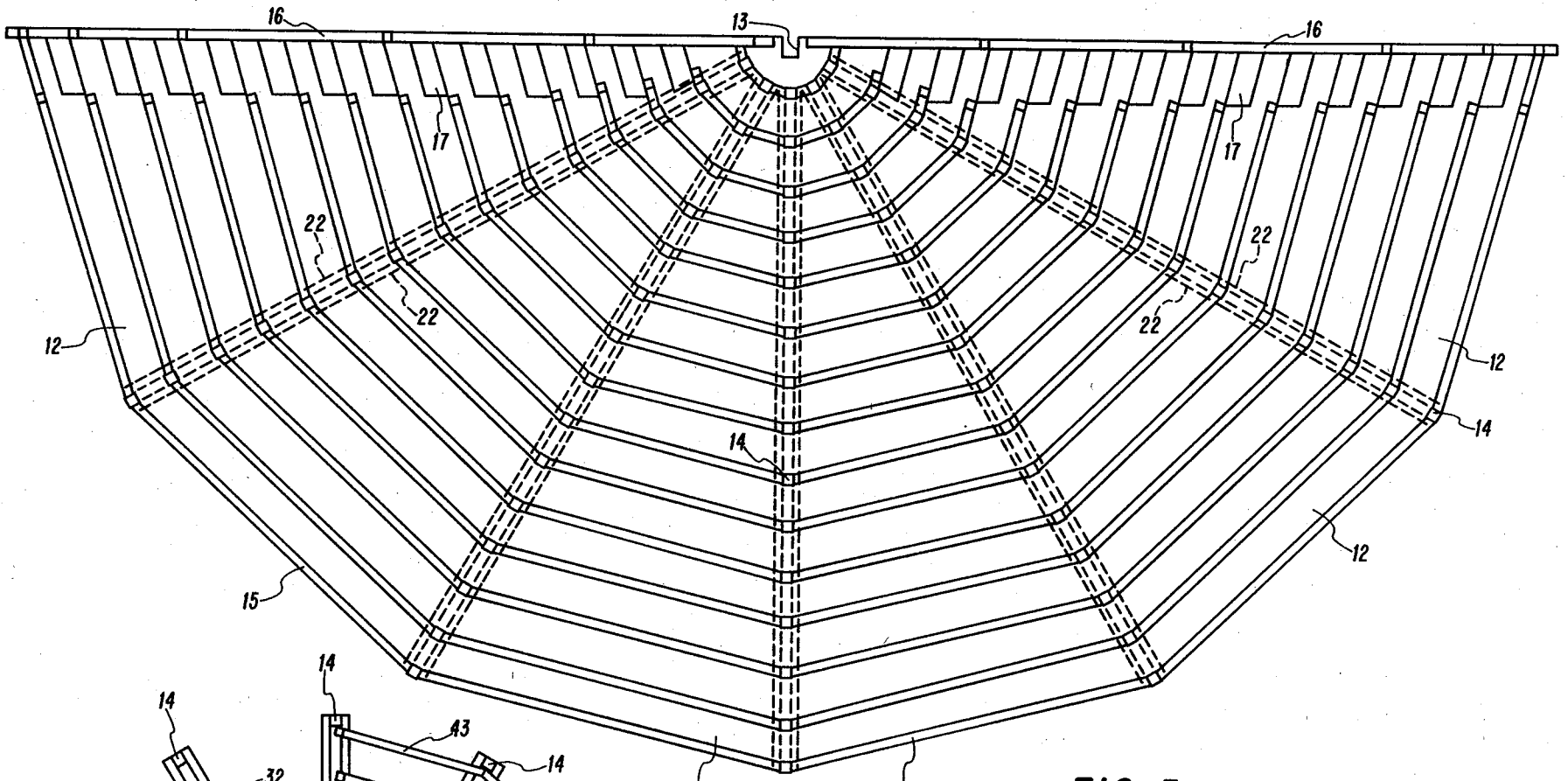
FIG. 5 is a top plan view of the scaffold assembly according to the present invention; and, FIG. 6 is a top plan view illustrating the respective interconnections among the various support members of the scaffold assembly according to the present invention.

Referring to FIGS. 3 and 5, scaffold assembly 31 includes a first set of horizontal support beams 22, which are attached at respective one ends thereof to respective tie plates 21 and extend radially outward therefrom to the underside of standing boards 12 at the respective opposite ends. Each horizontal support beam 22 is attached to a respective pair of vertical support posts 14 at the respective forward and rear edges of the corresponding standing boards 12 as best shown in FIG. 5. A second set of horizontal support beams 32, which are substantially shorter than support beams 22, are connected at respective one ends thereof to a respective vertical support posts 14 and at the respective opposite ends thereof to respective pairs of vertical support posts 14, beneath support boards 12, at the respective forward and rear edges of support boards 12, in much the same manner as the first set of horizontal support beams 22. Horizontal support beams 22 and 32 are attached to the respective support posts 14 at the respective intersections of standing boards 12, a support beam being attached on each side of a particular support post 14.

Each vertical support post 14 projects upwardly from a horizontal support beam 22 of the base tier, as depicted in FIG. 5, and is connected to corresponding pairs of horizontal support beams 22 and 32 at the forward edge of standing boards 12 of a corresponding tier and the rear edge of standing boards 12 of the next lower tier. Each support post 14 is connected to a horizontal support beam 22 of the base tier at a predetermined location therealong so that support post 14 is substantially in alignment with the forward edge of standing boards 12 of the corresponding tier and the rear edge of standing boards 12 of the next lower tier.

To enhance the integrity and stability of scaffold assembly 31, a plurality of brace members 33 are bolted to selected ones of vertical support posts 14, using an L-shaped plate and $\frac{3}{8}$ inch × $2\frac{1}{2}$ inch bolts and hex nuts, adjacent to the respective intersections of selected ones of support posts 14 and horizontal support beams 22. Brace members 33 extend diagonally between adjacent support posts 14 to define an X-shaped pattern and are each preferably comprised of a $\frac{3}{8}$ inch threaded metal rod.

Figure 4:
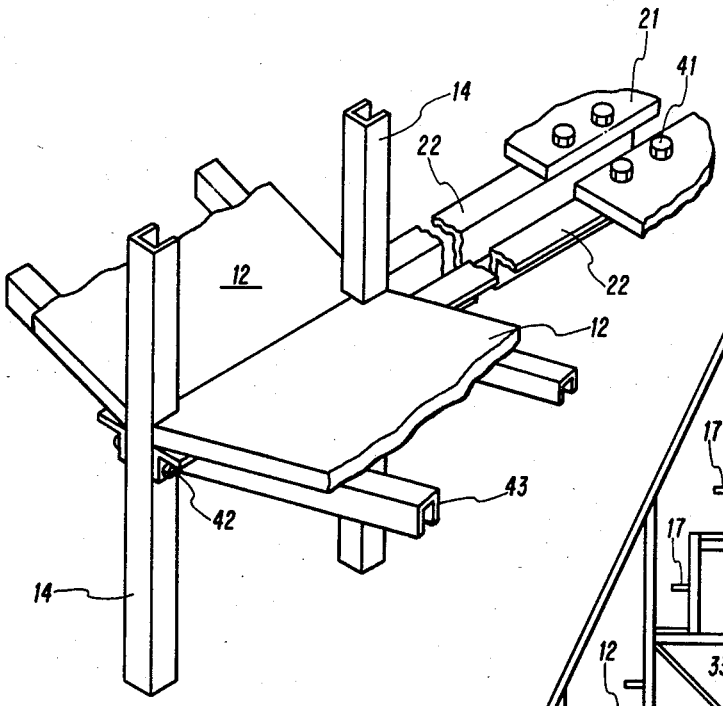
FIG. 4 is a perspective view illustrating the respective interconnections among the various support members of the scaffold assembly according to the present invention.
Figure 6:
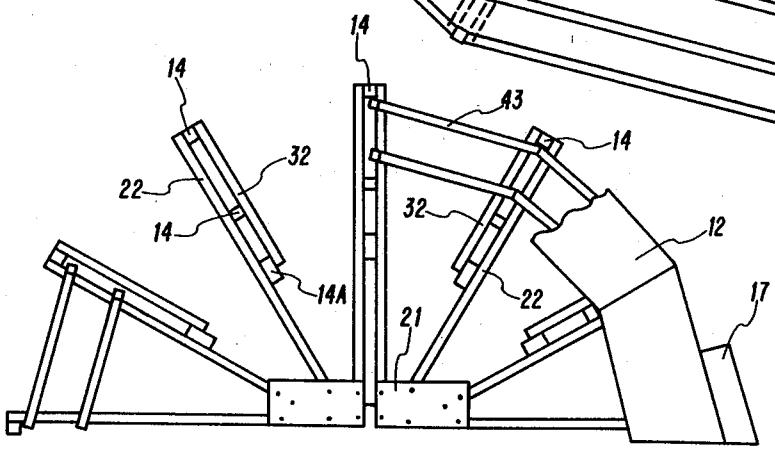

Referring to FIG. 4, horizontal support beams 22 are comprised of L-shaped steel beams of various lengths and sizes, depending upon the particular tier in which beams 22 are located. For example, support beams 22 in the lower tiers are the longest and are typically 2 inches × 2 inches wide across the two angled faces and $\frac{1}{4}$ inch thick. Support beams 22 in the upper tiers are shorter than support beams 22 in the lower tiers and are typically $1\frac{1}{2}$ inches × $1\frac{1}{2}$ inches wide across the angled faces and 3/16 inch thick. Referring also to FIG. 6, support beams 32 are substantially shorter than support beams 22 and are typically $1\frac{1}{2}$ inches × $1\frac{1}{2}$ inches wide across the angled faces and 3/16 inch thick in all the tiers.

Referring to FIG. 4, support beams 22 are bolted to a tie plate 21 using $\frac{3}{8}$ inch × 1 inch bolts 41 and hex nuts (not shown). Tie plate 21 is preferably a steel plate having a thickness of approximately 3/16 inech. Support beams 22 extend from the tie plate to beneath the intersection of standing boards 12 and are each connected to opposite sides of vertical support posts 14 which project upwardly at the respective forward and rear edges of standing boards 12, using $\frac{3}{8}$ inch × $2\frac{1}{2}$ inch bolts 42 and hex nuts (not shown). Support posts 14 are preferably comprised of a steel unistrut material of various lengths, having a substantially U-shaped cross-section and a vertical channel extending along the entire length thereof. The dimensions of support posts 14 are typically $1\frac{5}{8}$ inch × $1\frac{5}{8}$ inch × 12 guage (0.109 inch thickness).

Standing boards 12 are preferably comprised of plywood of $\frac{3}{4}$ inch thickness and 16 inches wide and are notched on the forward and rear edges at the intersections of adjacent standing boards 12, to receive support posts 14. Located beneath each of standing boards 12 are first and second parallel support members 43, which extend along the respective major axes of standing boards 12. Support members 43 are preferably comprised of steel unistrut material, having a substantially U-shaped cross-section and a vertical channel extending along the entire length thereof. The dimensions of support members 43 are typically $1\frac{5}{8}$ inch × $1\frac{5}{8}$ inch × 12 guage (0.109 inch thickness). Support members 43 are attached to the underside of standing boards 12 using countersunk metal screws (not shown), with the vertical channel facing downward away from standing boards 12. Horizontal support beams 22 are positioned beneath support members 43 and are attached thereto using $\frac{3}{8}$ inch × 1 inch bolts and $\frac{3}{8}$ inch strut nuts (not shown). Support members 43 are further attached to the respective vertical support posts 14 using $\frac{3}{8}$ inch × $2\frac{1}{2}$ inch bolts and $\frac{3}{8}$ inch strut nuts (not shown).

Referring to FIG. 6, horizontal support beams 32 are connected to the respective vertical support posts 14 and support members 43 in substantially the same manner as horizontal support beams 22 as described above with respect to FIG. 4, except that support beams 32 are attached at respective one ends thereof to respective support posts 14A, instead of a tie plate 21, and at the respective other ends to respective support posts 14 at the respective forward and rear edges of the corresponding standing boards 12.

The scaffold assembly of the present invention provides a stable, attractive structure, which simulates the appearance of a traditional Christmas tree. The structure can be quickly and conveniently assembled on site and is well-suited for hanging accessories such as music holders, Christmas decorations, artificial or live greenery and the like.

Although the invention has been described with reference to a specific embodiment, and with reference to a specific musical choir application, the foregoing description is not intended to be construed in a limiting sense. Modification of the disclosed embodiment as well as alternative applications of the invention may be suggested to persons skilled in the art upon review of the foregoing specification and illustrations. For example, the scaffold assembly of the invention may be modified to support a musical choir group in an Easter Cross configuration. Moreover, substitutions of specific materials may be made from time to time either for engineering improvements, for manufacturing or cost considerations, i.e. 12 gauge "U" shaped channels may be a lighter gauge in the shorter length members or L, and Z or any other shaped material may be used as long as the strength requirements are met. It is therefore contemplated that all such modifications or embodiments will be comprehended by the invention as defined by the appended claims.

What is claimed is:

1. A scaffold assembly for supporting members of a musical choir or the like in standing arrangement simulating the appearance of a traditional Christmas tree, said scaffold assembly comprising in combination:

a plurality of tiers of horizontal standing boards rising one above and one behind another from a base tier of standing boards to an uppermost tier of standing boards, each tier including a plurality of horizontal standing boards disposed end-to-end and arranged to form a segmented arc substantially in a plane which is transverse to the vertical axis of the scaffold assembly;

a plurality of horizontal support beams, at least portions of which extend beneath said standing boards at the respective intersections of said standing boards;

a plurality of upright support posts projecting upwardly from horizontal support beams of the base tier, each upright support post being attached to respective pairs of said horizontal support beams at the respective rear edge of the standing boards of the next lower tier; said horizontal support beams being attached to respective pairs of said support posts at the respective forward and rear edges of the standing boards of the respective tiers;

a central stanchion post projecting upwardly from one of the horizontal support beams of the base tier, selected axes of said horizontal support beams extending substantially radially outwardly from predetermined positions along said stanchion post to the respective intersections of said standing boards.

2. The scaffold assembly of claim 1 further including a plurality of tie plates attached to said central stanchion post at predetermined positions therealong corresponding to selected ones of said tiers, the horizontal support beams associated with said selected ones of said tiers being attached to the respective tie plates and extending substantially radially outwardly therefrom to the respective intersections of the standing boards of the respective tiers.

3. The scaffold assembly of claim 2 wherein the horizontal support beams attached to particular ones of said tie plates extend radially outwardly from said tie plates with substantially equal angular intervals therebetween.

4. The scaffold assembly as defined in claim 2 wherein an end portion of each upright support post projects above the forward edge of the standing boards of the corresponding tier and a plurality of horizontal chest rails one connected to said projecting end portions of selected ones of the upright support posts in each tier, said chest rails defining a segmented arc in a plane substantially parallel with the plane in which said standing boards define a segmented arc.

5. The scaffold assembly according to claim 2 further including a plurality of support means disposed beneath said standing boards and attached thereof, said support means being comprised of first and second support members disposed in substantially parallel relationship beneath said standing boards and extending along the respective major axes of said standing boards.

6. The scaffold assembly according to claim 5 further including first and second hand rails disposed on opposite sides of said scaffold assembly and extending substantially from the base tier to the uppermost tier of said scaffold assembly, the end portions of the upright support posts which are not connected to said chest rails being connected to a corresponding handrail.

7. The scaffold assembly according to claim 6 further including a plurality of steps attached to said scaffold assembly at opposite sides thereof between said tiers to facilitate ascent and descent of said scaffold assembly.

8. The scaffold assembly according to claim 6 wherein said central stanchion post, said upright support posts, said first and second support members, said chest rails and said hand rails are each comprised of steel unistrut material having a substantially U-shaped channel extending along the major axis thereof and said horizontal support beams are each comprised of an elongated metal beam having a substantially L-shaped section.

9. The scaffold assembly according to claim 1 further including a plurality of brace members attached to the scaffold assembly adjacent to the intersections of selected ones of said horizontal support beams and said upright support posts, said brace members extending diagonally between adjacent support posts in an X-shaped pattern.

10. The scaffold assembly according to claim 9 wherein said brace members are each comprised of a threaded metal rod.

* * * * *